United States Patent [19]

Stancato

[11] Patent Number: 5,056,823

[45] Date of Patent: Oct. 15, 1991

[54] ALBUM DESIGN

[76] Inventor: Enzo Stancato, 33 Windy Knolls, Greenwich, Conn. 06830

[21] Appl. No.: 436,657

[22] Filed: Nov. 15, 1989

[51] Int. Cl.[5] ..... B42D 5/00

[52] U.S. Cl. ..... 281/49; 281/15.1; 281/45; 40/530

[58] Field of Search ..... 281/45, 46, 47, 49, 281/15.1; 40/530, 537, 158.1; 211/169, 96; 248/470, 487

[56] References Cited

U.S. PATENT DOCUMENTS

| | | | |
|---|---|---|---|
| 4,294,029 | 10/1981 | Holson | 40/530 |
| 4,378,647 | 4/1983 | Stancato | 40/158.1 |
| 4,426,007 | 1/1984 | Beleckis et al. | 211/169 |
| 4,445,710 | 5/1984 | Borel | 281/45 |
| 4,557,503 | 12/1985 | Linn | 281/47 |
| 4,561,623 | 12/1985 | Shepherd et al. | 281/47 |
| 4,591,187 | 5/1986 | Jeanson et al. | 281/46 |
| 4,601,489 | 7/1986 | Stancato | 40/530 |
| 4,934,739 | 6/1990 | Stancato | 40/158.1 |

*Primary Examiner*—Frank T. Yost
*Assistant Examiner*—Hwei-Siu Payer
*Attorney, Agent, or Firm*—Allen R. Morganstern

[57] ABSTRACT

This invention relates to a new and improved design associated with the fabrication and construction of a prebound album wherein the individual pages of the album are selectively interchangeable in accordance with the invention, each particular page evidencing a new and unique method of fabrication and construction capable or having mounted thereon, in accordance with the invention, a photograph or other item for display purposes so as to achieve an overall aesthetically appearing album design.

Additionally, through the utilization of a unique binder assembly in conjunction with the unique design of the albums individual pages, there is achieved an interrelationship between the album binder and the individual album page wherein there is realized the ability to selectively add or delete individual pages to the album without disturbing the prebound aesthetic appearance thereof.

13 Claims, 10 Drawing Sheets

ALBUM DESIGN

BACKGROUND AND OBJECTS OF THE INVENTION

The present invention relates generally to a new and improved design for the fabrication and construction of a prebound album wherein the individual pages of said album are selectively interchangeable in accordance with the invention, each particular page evidencing a new and unique method of fabrication and construction capable of having mounted thereon, in accordance with the invention, a photograph or other item for display purposes so as to achieve an overall aesthetically appearing album design.

Additionally, through the utilization of a unique binder assembly in conjunction with the unique design of the albums individual pages, there is achieved an interrelationship between the album binder and the individual album page wherein there is realized the ability to selectively add or delete individual pages to the album without disturbing the prebound aesthetic appearance thereof.

Although it is well known in the prior art to have a photoalbum that has interchangeable pages associated therewith, the present design as related to the individual album pages and the binder structure associated therewith evidence a new and unique design as related thereto and provides an album design unique in structure which is neither taught nor disclosed in the prior art.

In keeping with the invention, each page of said album is fabricated so as to evidence a particular structural pin arrangement that is capable of mechanical interfit with the albums unique binder such that there is achieved the ability to interchange particular album pages within said album design without altering the album's aesthetic appearance as to the evidencing of a prebound design.

In keeping with the invention, it is an object of the present invention to create an album design that aesthetically evidences a prebound appearance but yet allows for the interchangeability of individualized album pages.

It is another object of the present invention to create a new and improved album design wherein individualized album pages have a unique pin structure capable of mechanical interfit with the structure of the album's binder so as to allow for the selective insertion and/or removal therefrom of a particular album page as related to said album.

It is another object of the present invention to create a new and improved album design which has a binder structure capable of receiving in mechanical interfit the pin structure of an album page such that said pin structure is able to rotate about its axial length while remaining structurally bound within the album's binder structure.

It is another object of the present invention to create a new and improved album design which utilizes a new and improved page format capable of selective insertion and/or removal with regard to said album design.

It is another object of the present invention to create a new and improved album design whereby new and improved mat designs are utilized in conjunction with said new and improved page formats whereby said mats are capable of being structurally locked into place within said page format.

The objects and advantages of the invention are set forth in part herein and in part will be obvious herefrom, or may be learned by practice of the invention, the same being realized and attained by means of the instrumentalities and combinations pointed out in the appended claims.

The invention consists in the novel parts, constructions, arrangements, combinations and improvements herein shown and described.

DESCRIPTION OF A PREFERRED EMBODIMENT

Figure 1:
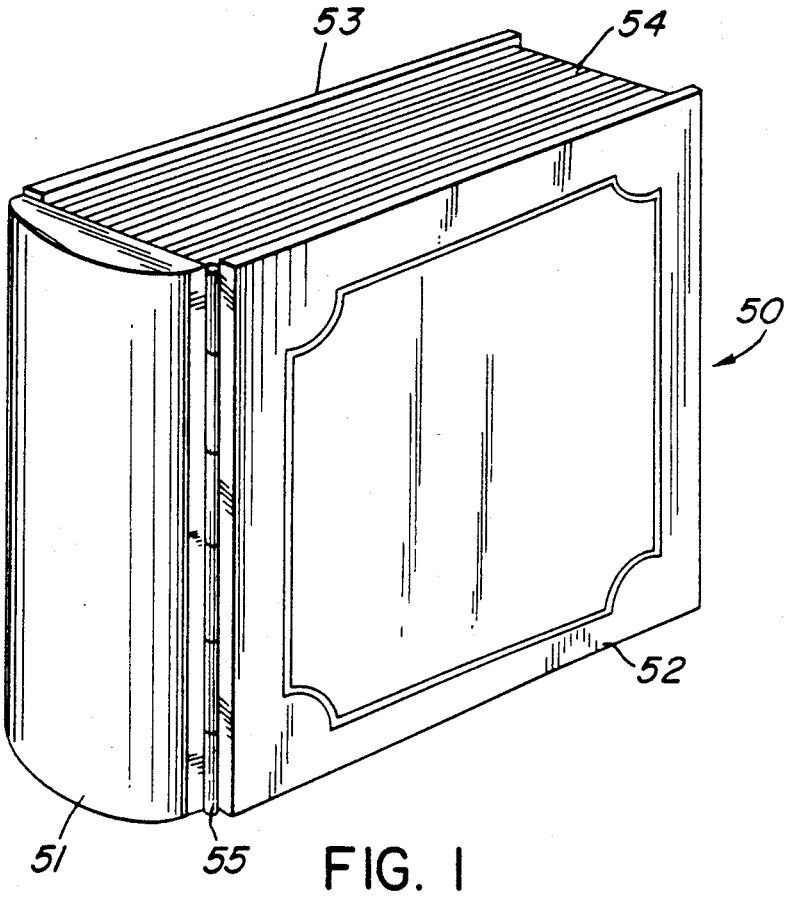
FIG. 1 is a three dimensional perspective view of an album constructed in accordance with the invention wherein there is evidenced a prebound appearance as related to said album even though said individualized pages can be selectively removed and/or inserted therein.

Reference is now herein made to FIG. 1 wherein there is illustrated a three dimensional perspective view of an album 50 constructed in accordance with the invention depicting binder member 51, front cover member 52, back cover member 53 and individual page members 54. Additionally, illustrated in FIG. 1 is rotatable hinge structure 55 which is utilized as the mechanical means to interconnect front cover member 52 with binder member 51 and back cover member 53 with binder member 51.

It should be noted that it is within the scope of this invention to utilize any hinge structure 55 well known within the prior art as the means to provide a rotatable mechanical interfit between binder member 51 and front cover member 52 and back cover member 53. As an example of such a hinge structure, reference is herein made to U.S. Pat. No. 4,601,489, entitled "ALBUM DESIGN AND METHOD OF FABRICATION", the inventor herein being the inventor as related to U.S. Pat. No. 4,601,489, wherein a hinge structure capable of providing said rotational mechanical interfit as set forth above is taught and otherwise disclosed.

Figure 2:
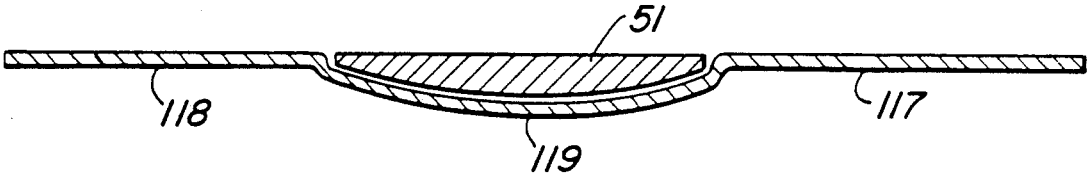
FIG. 2 is a cross sectional view of an alternative embodiment as related to the mechanical interrelationship between said album's binder and its front and back covers.

It should additionally be noted that it is within the scope of this invention to omit the utilization of any formalized pin structure 55 as illustrated in FIG. 1, and in the alternative, to utilize a one piece album cover as illustrated in FIG. 2. As illustrated in FIG. 2, front cover member 117 and back cover member 118 form one continuous structure with binder member 119 such that at the point of interconnection between binder member 119 with front cover member 117 and binder member 119 with back cover member 118, a flexible point is achieved in a manner well known in the prior art so as to allow front cover member 117 and back cover member 118 to rotate about said flexible point just as is the case with any book's cover and its binding.

Figure 3:
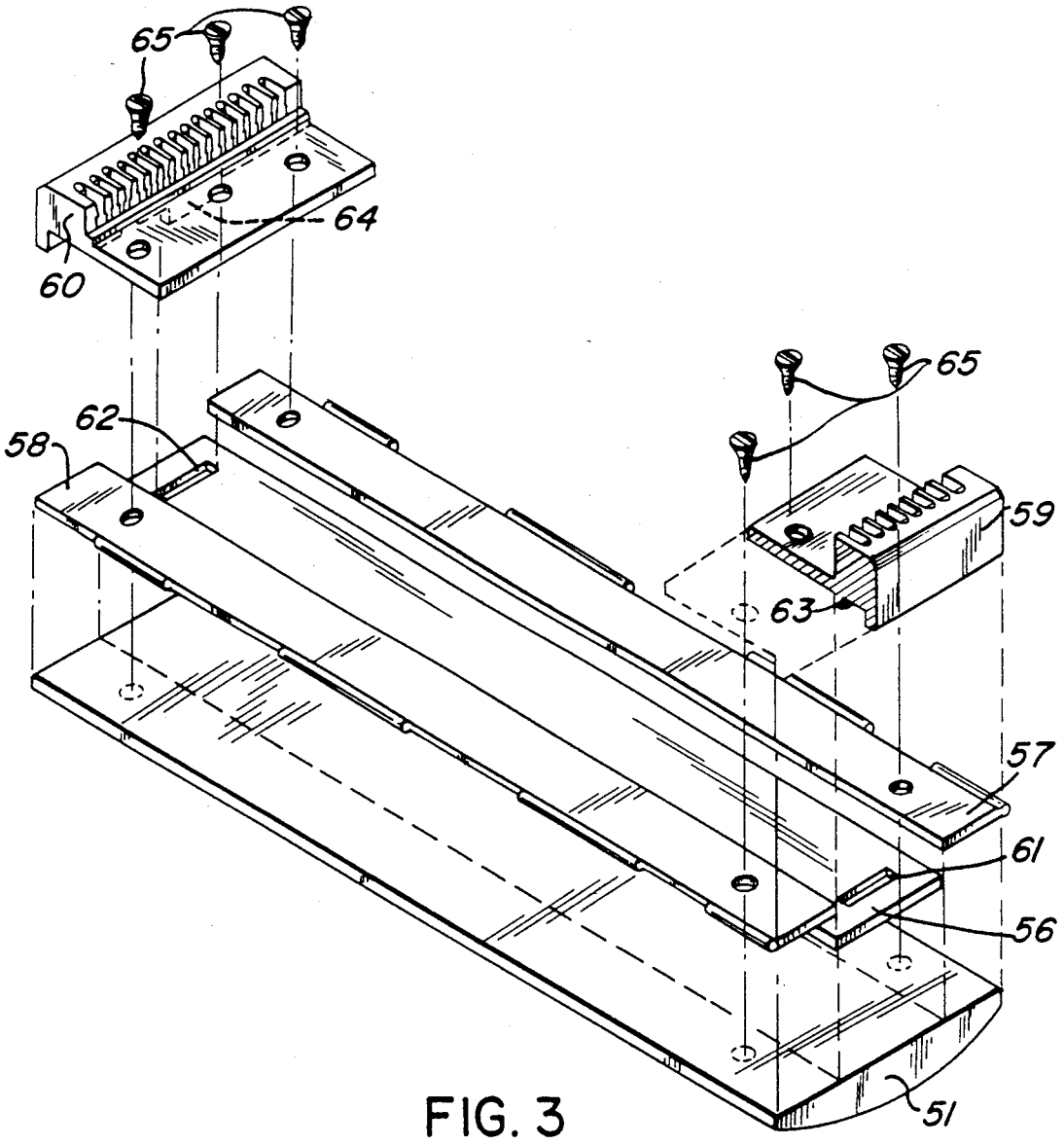
FIG. 3 is an exploded three dimensional perspective view evidencing the components associated with the binder utilized in conjunction with an album constructed in accordance with the invention.

In further keeping with the invention, reference is herein made to FIG. 3 wherein there is illustrated a three dimensional perspective view of that portion of album 50 as related to binder member 51 and the related components associated therewith which combine to form, in part, album 50.

As further illustrated in FIG. 3, guide strip 56, front cover hinge 57, back cover hinge 58, pin housing structure 59 and pin housing structure 60 are depicted in an exploded, three dimensional perspective view of said components all aligned for assembly in accordance with the invention.

More particularly, binder member 51 has placed upon its flat upper surface guide strip 56, guide strip 56 being centered and otherwise symmetrically positioned along the entire length of binder member 51, said guide strip 56 being adhesively affixed to binder member 51.

Slots 61 and 62 as illustrated in FIG. 3 are formed in guide strip 56 so as to assist in the mounting of housing structures 59 and 60 thereon so as to achieve exact alignment therebetween.

In further keeping with the invention, front cover hinge 57 and back cover hinge 58, as illustrated in FIG. 3 are then each aligned parallel to guide strip 56 and upon the flat surface of binder member 51. As stated above, front cover hinge 57 and rear cover hinge 58 as illustrated in FIG. 3 are of a structure well known in the prior art and have been disclosed in U.S. Pat. No. 4,601,489, the inventor therein and the inventor herein, being one in the same.

As further depicted in FIG. 3, after front cover hinge 57 and rear cover hinge 58 have been placed upon binder member 51 as discussed above and as illustrated in FIG. 3, pin housing structures 59 and 60 are then positioned on top of guide strip 56, front cover hinge 57 and back cover 58 with guide member 63 of pin housing structure 59 fitting within slot 61 thereof, and guide member 64 of pin housing structure 60 fitting within slot 62 thereof, it being in keeping with the invention that slots 61 and 62 of guide strip 56 are of dimensions so as to receive in close mechanical interfit guide members 63 and 64 of pin housing structures 59 and 60 respectively.

In conjunction with the above, and in keeping with the invention, the thicknesses of guide strip 56, front cover hinge 57, and back cover hinge 58 are all identical so as to form a uniform plane surface across the top of binder member 51 once same are placed thereon as illustrated in FIG. 3. Additionally, the depth of slots 61 and 62 equate to the thickness of guide strip 56.

Upon assembling the above referenced components in accordance with FIG. 3, screw members 65 are utilized to fasten same together in mechanical interfit as therein illustrated.

It should additionally be noted that the scope of the invention is not limited only to the utilization of the components illustrated in FIG. 3, but that variations thereof are also embodied within the scope of the invention. As an example, but not limited thereto, pin housing structures 59 and 60 could be mechanically affixed directly to binder member 51 without the utilization of front cover hinge 57, back cover hinge 58 and guide strip 56 and an album cover arrangement as illustrated in FIG. 2 could be utilized as an illustration of such a variation.

Figure 4:
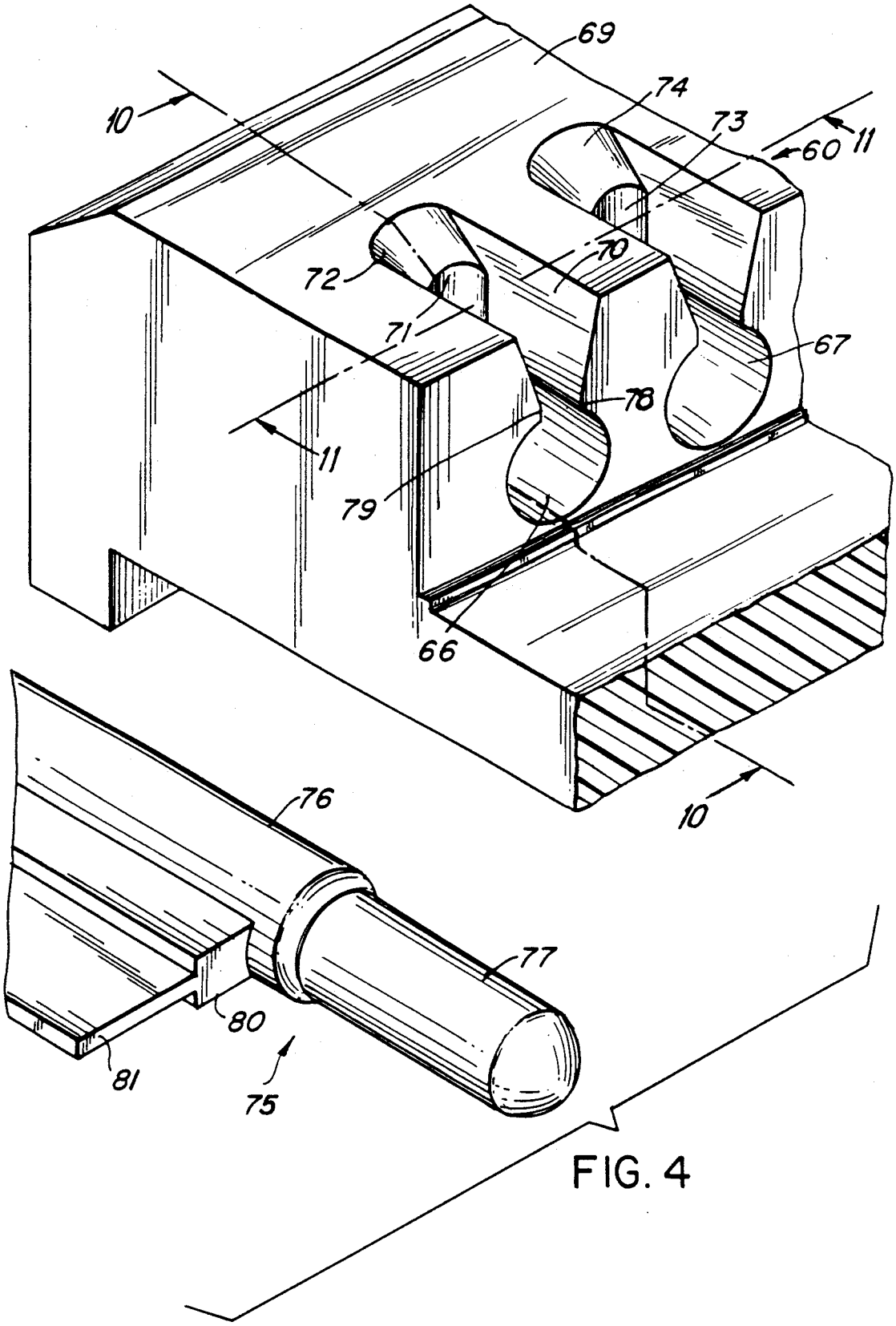
FIG. 4 is a partial perspective view of the pin housing structure along with a partial perspective view of the pin member as utilized in accordance with the invention.

In keeping with the invention, reference is now herein made to FIG. 4 which is a partial three dimensional perspective view of pin housing structure 60 as illustrated in FIG. 3. As illustrated in FIG. 4, pin housing structure 60 has formed throughout its length identical and equally spaced recessed cavities capable of receiving the insertion therein in mechanical interfit of the pin portion of an album page.

As illustrated in FIG. 4, there is depicted recessed cavity 66 and recessed cavity 67, similar recess cavities being similarly formed along the entire length of pin housing structures 59 and 60 as depicted in FIG. 3. As illustrated in FIG. 4, recessed cavity 66 comprises a cylindrical shaft formed within the body of pin housing structure 60 and below the top surface 69 of pin housing structure 60. Formed through the structure of pin housing structure 60 and axially aligned with the axis of recessed cavity 66 and positioned directly above recessed cavity 66 is trapezoid opening 70, trapezoid opening 70 being so formed so as to intersect with recessed cavity 66 formed within pin housing structure 60 so as to allow for the direct access to recessed cavity 66 from a location above top surface 69 of pin housing structure 60. As illustrated in FIG. 4, an identical configuration as related to recessed cavity 66 and trapezoidal opening 70 exists for each and every recessed cavity formed within pin housing structure 59 and pin housing structure 60 (see FIG. 3), there only being two such configurations (recessed cavity 66 and recessed cavity 67) illustrated in FIG. 4.

As is further illustrated in FIG. 4 trapezoid opening 70 defines a vertical back wall 71 as formed within the body of pin housing structure 60. There is additionally formed within the structure of pin housing structure 60 adjacent to the top portion of back wall 71, slanted guide surface 72 as illustrated in FIG. 4. By utilization of slanted guide surface 72 in conjunction with the structure of pin housing structure 60, there is facilitated in accordance with the invention the insertion of a page into pin housing structures 59 and 60. In keeping with the above, it should be noted that there is similarly formed within the structure of pin housing structure 60 as related to recessed cavity 67 and back wall 73, slanted guide surface 74. Furthermore, the above structure as related to the preferred embodiment depicted in FIG. 4 and as discussed above as related to the partial perspective view depicted as to pin housing structure 60, is repeated throughout the entire structure of pin housing structure 60 as well as related to pin housing structure 59.

Figure 5:
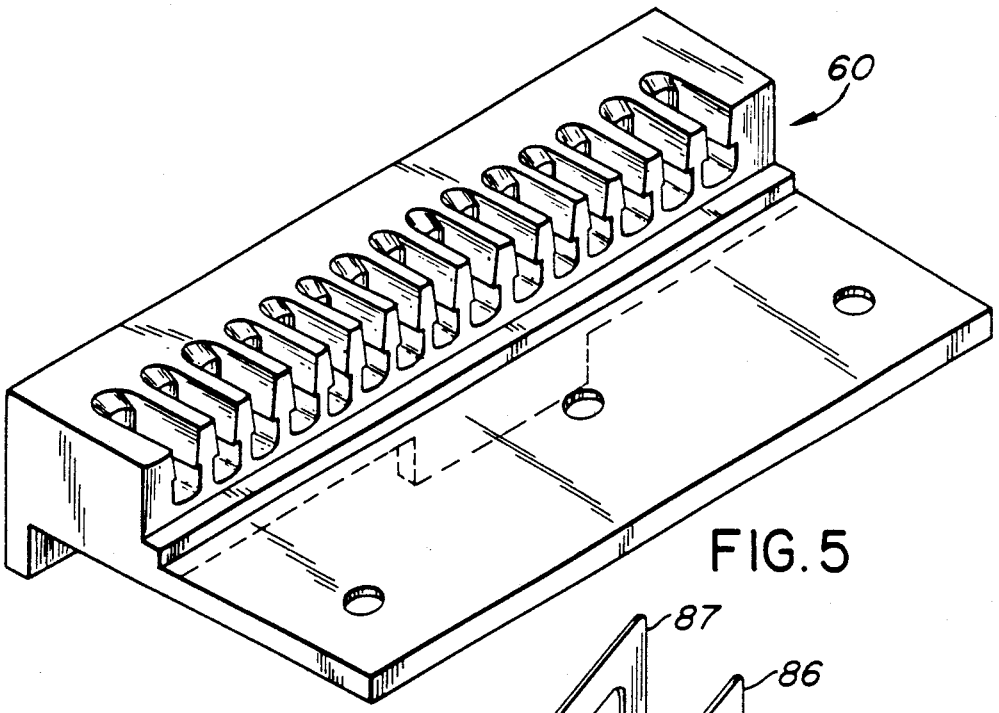
FIG. 5 is an enlarged three dimensional view of a pin housing structure utilized in conjunction with the invention.

In keeping with the invention, there is illustrated in FIG. 5 an enlarged three dimensional perspective view of pin housing structure 60 constructed in accordance with the invention.

In keeping with the invention, and as further illustrated in FIG. 3, it is within the scope of this invention to utilize any number of recessed cavities (66 and 67 as illustrated in FIG. 4) formed within pin housing structures 59 and 60, the number of such cavities determining the page capacity of any particular album constructed in accordance with the invention.

In further keeping with the invention, it should be further noted that as related to a particular album constructed in accordance with the invention, pin housing structure 59 is identical to pin housing structure 60, the alignment of pin housing structure 59 with pin housing structure 60 upon structurally affixing same to binder member 51 as discussed above as related to FIG. 3 is such as to align the axis of each of the respective corresponding cylindrical shaft members formed within each of said respective pin housing structures to their respective counterparts.

Further illustrated in FIG. 4 is a partial perspective view of a portion of the structure of interconnecting pin array 75 wherein there is illustrated pin member 76 having a tapered and blunted pin head 77, pin head 77 being of a diameter capable of passing between protrusion points 78 and 79 of pin housing structure 60 and thus capable of rotational movement within recessed cavity 66 or their counterparts formed within pin housing structures 59 and 60 respectively. Extension member 80 is structurally affixed to pin member 76 and structural member 81 in turn is structurally affixed to extension member 80, but of a lesser thickness. As therein illustrated, it is within the scope of this invention to have pin member 76 with its pin head 77, structural member 81 and extension member 80 constructed and/or molded as a single unit.

Figure 6:
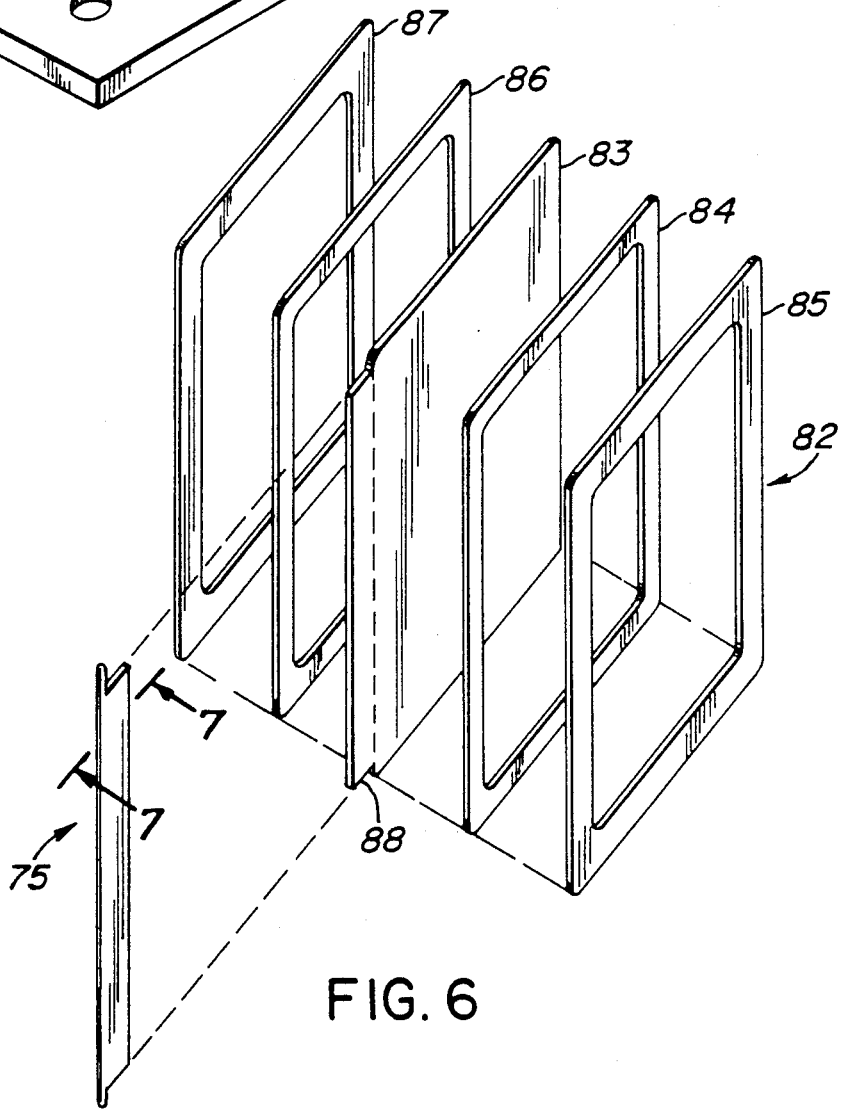
FIG. 6 is a three dimensional perspective perspective view of the component parts of a five layer page construction in accordance with the invention.

In conjunction with the above, reference is now made to FIG. 6 wherein there is illustrated a three dimensional perspective view of the component parts of an album page 82 constructed in accordance with the invention.

As therein illustrated, page 82 comprises interconnecting pin array 75, center core member 83, bottom guide member 84, top guide member 85, bottom guide member 86 and top guide member 87. Center core member 83 as illustrated in FIG. 6, is basically rectangular in shape, however, it is within the scope of the invention for center core member 83 to be of any geometric shape, be it square, or otherwise.

Structurally affixed and an inherent component of center core member 83 is extension member 88. Extension member 88, center core member 83 and structural member 81 of interconnecting pin array 75 (FIG. 7) are all of the same thickness. Additionally, the length of structural member 81 equates to the length of extension member 88.

Figure 15:
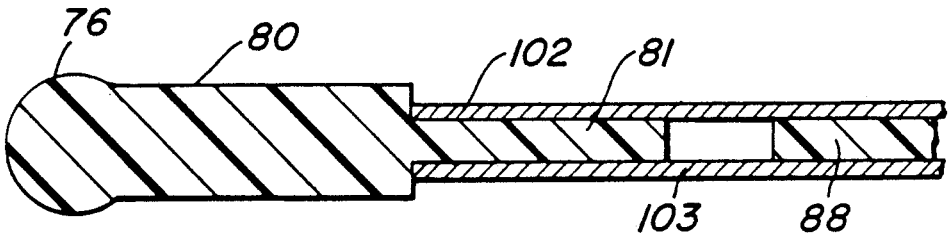
FIG. 15 is a partial cross sectional view of the interconnecting pin array evidencing its affixing to a page in accordance with the invention.

In keeping with the invention, and as illustrated in FIG. 15 and as will be hereinafter discussed as related to FIG. 15, interconnecting pin array 75 is structurally affixed to extension member 88 of center core member 83.

In keeping with the invention, and as further illustrated in FIG. 6, bottom guide members 84 and 86 as therein illustrated, are rectangular in shape and each define a center, square opening as well as having outer dimensions equatable to those of center core member 83. Additionally, top guide members 85 and 87, as illustrated in FIG. 6, are each rectangular in shape and each define a center, rectangular opening as well as each have outer dimensions equatable to these of center core member 83. In accordance with the above, it should be noted that the scope of the invention is not limited to having center core member 83, bottom guide members 84 and 86, or top guide member 85 and 87 define only a rectangular shape or for bottom guide members 84 and 86 to define only square openings while top guide members 85 and 87 define only rectangular openings, but rather, it is within the scope of this invention for the above components and related openings to be applicable to any geometric shapes and in any combinations. Additionally, as related to the openings formed within bottom guide members 84 and 86 and top guide members 85 and 87, said openings can be such as to define more than one opening per member. More particularly, it is within the scope of the invention to have, as for example, compatible openings formed in top guide member 85 and bottom guide member 84 and/or top guide member 87 and bottom guide member 86 respectively, that are multiple in nature and varied in shape such that, for example, on the same surface of page 82 a circular opening is in the upper half of said page while the lower half thereof has defined thereon an oval opening, and so on as to as many and as to as varied number of shapes desired.

Figure 8:
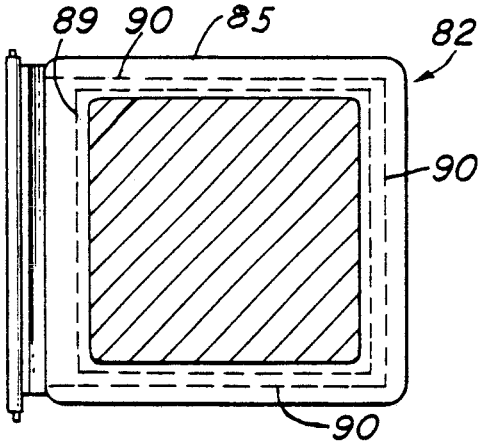
FIG. 8 is a front elevaltional view of page 82 of FIG. 6 but in an assembled format.

Additionally, as illustrated in FIG. 6, it should be noted that the openings defined by bottom guide members 84 and 86 are slightly larger than the openings defined by top guide members 85 and 87. Since top guide members 85 and 87 define openings that are symmetrically positioned comparable to the symmetrically positioned opening of bottom guide members 84 and 86, upon the superimposing of top guide member 85 upon bottom guide member 84 and top guide member 87 upon bottom guide member 86, there is achieved, as illustrated in FIG. 8, an overlap of top guide members 85 and 87 as related to the openings defined by bottom guide members 84 and 86. More particularly, the edge of bottom guide member 84 adjacent to the opening defined therein, to wit, edge 89, has formed on top of it top guide member 85 such that top guide member 85 provides an overlapping frame about edge 89 of bottom guide member 84 as illustrated in FIG. 8.

As illustrated in FIG. 6, page 82 is assembled by having bottom guide members 84 and 86 structurally affixed to center core member 83 by the use of adhesive material, or otherwise, in a manner well known within the prior art.

After having structurally affixed bottom guide members 84 and 86 to center core member 83 by having the entire surface of bottom guide members 84 and 86 respectively that comes into contact with center core member 83 so affixed, there is then structurally affixed top guide members 85 and 87 to bottom guide members 84 and 86 respectively by use of adhesive material, or otherwise as is well known in the prior art.

It should be noted that adhesive material is applied only to the common surfaces between top guide member 85 and bottom guide member 84 and top guide member 87 and bottom guide member 86 respectively, as illustrated in FIG. 8, to wit, between the common surfaces occurring between the outer edge of said members and adhesive line 90. As a result, there is created an envelope type structure on both the front and back portions of page 82 whereby there can be slipped into and out of the pouch created between top guide member 85 and bottom guide member 84 as well as between top guide member 87 and bottom guide member 86 respectively, pictures and the like which are mounted upon various mat structures which are then capable of being locked into place as will be more fully set forth hereinafter, all of the above being in accordance with the invention.

Figure 7:
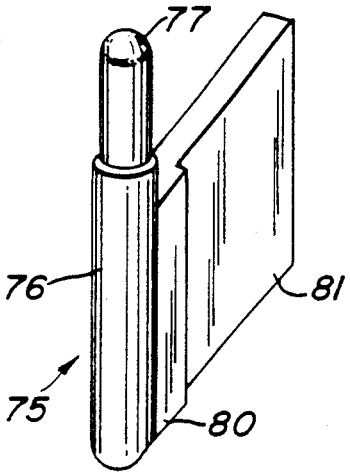
FIG. 7 is a partial three dimensional perspective view of the interconnecting pin array as illustrated in FIG. 6 as taken along lines 6—6.

Reference is herein made to FIG. 7 which is a partial enlarged perspective view of interconnecting pin array 75 of FIG. 6, its structure being identical to that depicted in FIG. 4, reference being herein made to the disclosure set forth above as related to FIG. 4 regarding interconnecting pin array 75.

Figure 9:
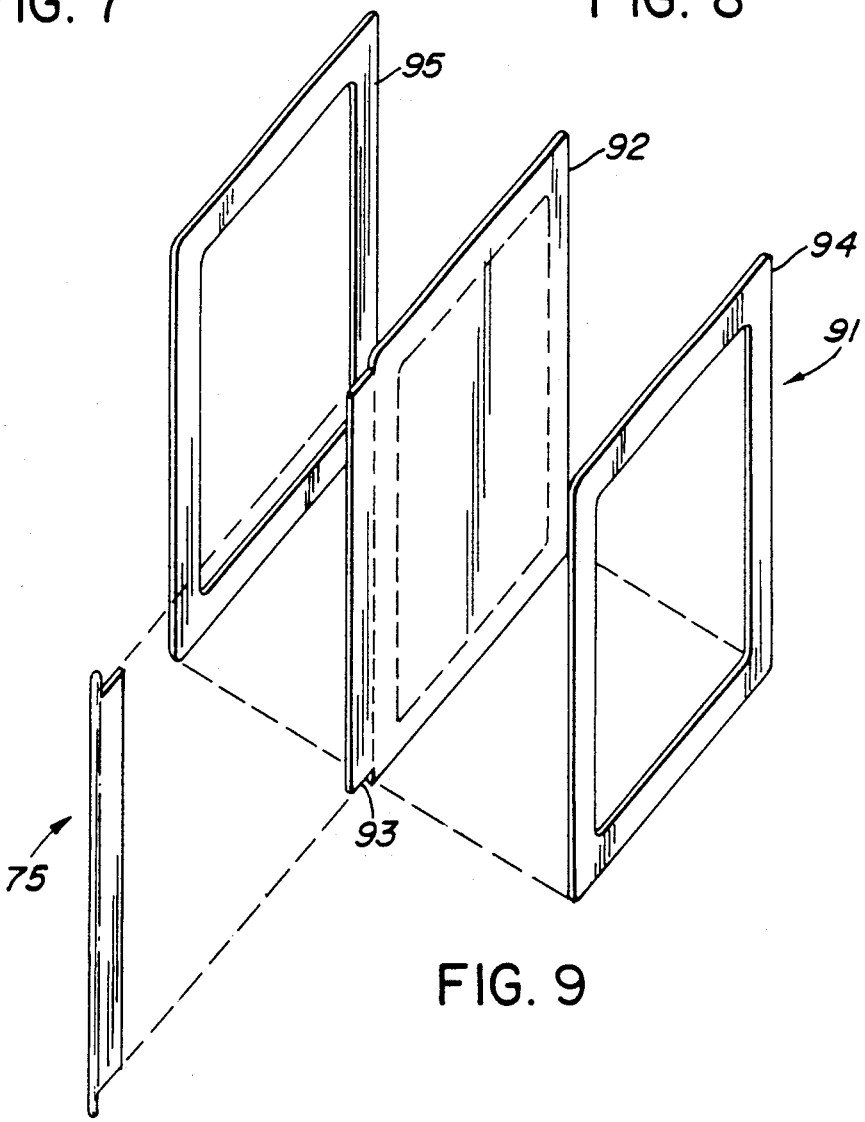
FIG. 9 is a three dimensional perspective view of the component parts of a three layer page constructed in accordance with the invention.

In addition to having a five layer page 82 as described above and as illustrated in FIGS. 6 and 7, it is also within the scope of this invention to utilize a three layer page 91. As illustrated in FIG. 9, center core member 92 is constructed identical to and utilized in the same manner as was described above with regard to said five layer page 82 and center core member 83, extension member 93 also fashioned and functioning in the same manner as extension member 88 as was described with regard to page 82. Similarly, interconnecting pin array 75 as illustrated in FIGS. 6 and 7 as related to five layer page 82, is identical in use, structure and function as described above as related to FIG. 9 and page 91.

In keeping with the invention, and as illustrated in FIG. 9, center core member 92 has structurally affixed to its respective surfaces, by adhesive means or otherwise, top guide member 94 and bottom guide member 95. Top guide member 94 and bottom guide member 95, as illustrated in FIG. 7 are rectangular in shape, have outer identical dimensions as related to each other as well as equal to the outer dimensions of center core member 92 as well as defining identical center square openings. Upon structurally affixing top guide member 94 and bottom guide member 95 to the respective surfaces of center core member 92, there is created page 91 capable of receiving within the recessed square cavity thereby defined, mounted pictures, and the like, as will be more fully set forth hereinafter.

As previously discussed as related to page 82, nothing herein contained should be considered to limit page 91 and the openings formed in top guide member 94 and bottom guide member 95 to the geometric shapes depicted in FIG. 9, it being within the scope of the invention to utilize any conceivable geometric shape as well as to have more than one opening formed on a particular surface of page 91 at any one time.

In keeping with the invention, it should be noted that individual pin housing structure 59 and individual pin housing 60 as illustrated in FIG. 3 are structurally affixed to binder member 51 as therein illustrated. It should be noted that the overall distance between pin housing structure 59 and pin housing structure 60 is such that the distance between the respective ends of the pin heads 77 of a particular interconnecting pin array 75 as related to a particular page, be it page 82 (FIG. 6) or page 91 (FIG. 9), have an overall length slightly longer than the distance existing between the respective back walls 71 of trapezoidal opening 70 as formed in pin housing structure 60 and as comparably formed in pin housing structure 59 (FIGS. 3 and 4).

Figure 10:
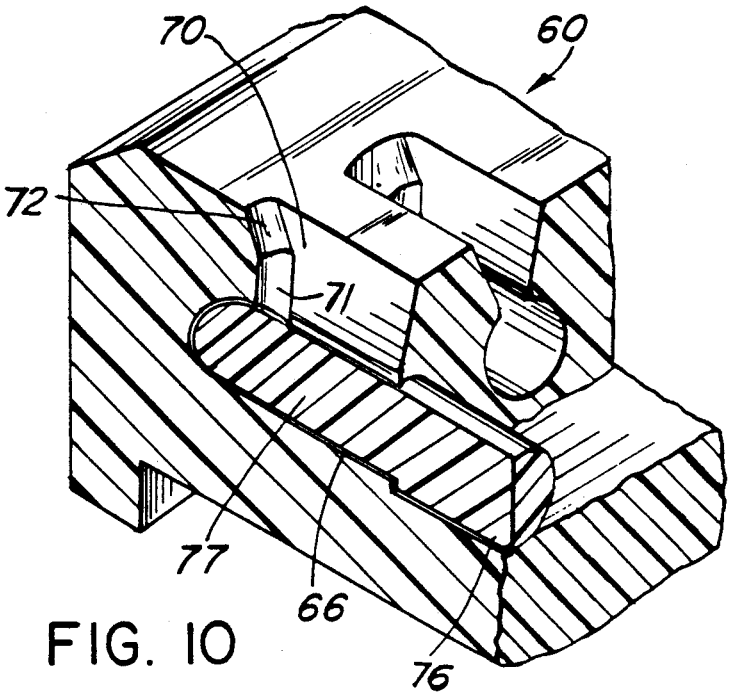
FIG. 10 is a partial three dimensional view of the pin housing structure depicted in FIG. 4 and taken along lines 10—10 thereof.

As a result, and as illustrated in FIG. 10, FIG. 10 being a cross-sectional view of pin housing structure 60 taken along lines 10—10 of FIG. 4, there is evidenced the fact that recess cavity 66 of pin housing structure 60 extends within the body of pin housing structure 60 beyond back wall 71 of trapezoidal opening 70. This feature of the invention will be evident upon understanding the method by which a page 82 or a page 91 is inserted within album 50.

More particularly, and as illustrated upon review of FIGS. 4 and 10, a particular page has the pin head 77 of interconnecting pin array 75 associated with said page pass down through trapezoidal opening 70 of pin housing structure 60 so as to have pin head 77 snap into recess cavity 66.

As illustrated in FIGS. 4 and 10, protrusion points 78 and 79 respectively are formed within the pin housing structure 60 by the fact that recess cavity 66 and trapezoidal opening 70 overlap in part, thereby providing a physical restraint to the placement of pin head 77 as same is passed downward through trapezoidal opening 70 into recess cavity 66. In effect, by applying a downward pressure to pin member 76 and thus pin head 77 thereof, pin head 77 is in effect snapped mechanically into recess cavity 66 and mechanically restrained from being lifted out without the application of force as a result of protrusion points 78 and 79 respectively.

Additionally, and as a further basis to provide a mechanical and structural interfit capable of holding pin member 76 within recess cavity 66 as illustrated in FIG. 10, pin head 77 of pin member 76 as therein illustrated protrudes to within the rear portion of recess cavity 66 which extends into pin housing structure 60 beyond the point where back wall 71 is located. As a result, an additional mechanical means separate and apart from protrusion points 78 and 79 acts to mechanically hold in place pin member 76 while allowing for it to rotate about its axis in accordance with the movement of a page of said album.

Since the above structural characteristics of pin housing structure 60 are identical throughout pin housing structure 60 as well as related to pin housing structure 59 and as indicated above, the respective recess cavities of pin housing structure 59 and pin housing structure 60 are axially aligned as illustrated in FIG. 3, there is achieved the selective mechanical placement into album 50 of a page 82 or of a page 91, as the case may be, by initially having pin head 77 of pin member 76 of one end of page 82 or 91 snap into recess cavity 66 of pin housing structure 60 and then axially moving pin member 76 thereof such that pin head 77 thereof moves into the body of pin housing structure 60 and past back wall 71 and comes into direct contact with the end of recess cavity 66 as depicted in FIG. 10.

Similarly, the other end of page 82 or 91, as the case may be, and its respective pin head 77 of its respective pin member 76 is comparably snapped into and otherwise inserted into pin housing structure 59 coincident with the equivalently aligned recess cavity associated therewith. Since the overall distance between the end points of the respective pin heads 77 of a particular pin member 76 as related to a particular page 82 or 91 is slightly greater than the lineal distance between the respective distances between the respecctive back walls 71 associated with a pair of respective aligned recessed cavities associated with pin housing structures 59 and 60, there is the necessity after having inserted pin head 77 of one end of page 82 as hereinabove set forth to slightly arc interconnecting pin array 75 along its entire length to thereby shorten the linear distance between the end points of the respective pin heads 77 of the respective interconnecting pin array 75 of said page as it is inserted into album 50 such that there is the ability then to insert, and otherwise snap into place said remaining pin head 77 as to the other end of pin member 76 of page 82 or 91 as associated with pin housing structure 59.

In accordance with the above, and in keeping with the invention, there is achieved the ability to selectively insert and/or withdraw from album 50 an individual page member (82 and/or 91) by snapping into or snapping out of the structure of pin housing structures 59 and 60 respectively the pin heads 77 of a particular interconnecting pin array 75 as associated with a particular page. As disclosed hereinabove, the mechanical interrelationship between the structural characteristics of pin housing structures 59 and 60 respectively as between themselves (axial alignment between themselves of respective recessed cavities) as well as related to pin head 77 of interconnecting pin array 75, results in the selective insertion and/or removal of a page from said album while providing a double locking mechanism for holding a page in said album while allowing for rotational movement of a page in said album about the axis of interconnecting pin array 75 of a particular page 82 or 91 thus allowing for the turning of pages in said album. Said doubling locking between a page 82 or 91 and pin housing structures 59 and 60 occurs due to the interaction between protrusion points 78 and 79 with pin head 77 and the insertion of the ends of pin head 77 into recessed cavity 66 beyond the point of back wall 71.

Additionally, it should be noted that the forming of slanted guide surface 72 as depicted in FIGS. 4 and 10 is such as to assist and otherwise facilitate the insertion of pin heads 77 of a particular interconnecting pin array 75 into the respective structures of pin housing structures 59 and 60 upon the insertion of a particular page into same.

Additionally, it should be noted that, although the above discussion of the insertion of a page into pin housing structures 59 and 60 dealt with only a single page and the placement thereof into a recessed cavity as associated therewith, that said discussion and description is applicable to each and every one of the respective recess cavities that are formed throughout the pin housing structures 59 and 60 as illustrated in FIG. 2 and is applicable to the insertion and/or removal of all pages associated with album 50.

Additionally, it should further be noted that nothing herein contained should so limit the structure of the corresponding portion of pin housing structures 59 and 60 as they are illustrated about recess cavity 66 as illustrated in FIGS. 4 and 10 but rather, it is within the scope of this invention to evidence a variety of cross-sectional configurations as taken along lines 11-11 of FIG. 4. More particularly, there is illustrated as alternative embodiments of the invention in FIGS. 11, 12, 13 and 14 various alternative embodiments of the invention illustrating different interrelationships between the respective recess cavities formed within the structure of the respective pin housing structures 59 and 60.

Figure 11:
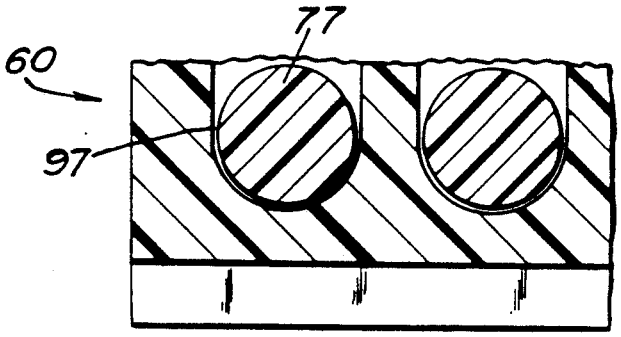
FIG. 11 is a partial front elevational view of an alternative embodiment of the pin housing structure depicted in FIG. 4 and taken along lines 11—11 as constructed in accordance with the invention.

In conjunction with the above, and in particular, with regarding to FIG. 11, the alternative embodiment as therein illustrated evidences in place of trapezoidal opening 70 in conjunction with recess cavity 66 of pin housing structure 60 (FIG. 4) there is simply formed within the structure of pin housing structure 60 a circular recessed cavity 97 the walls of which allow for the direct insertion of a pin head 77 as associated with a page constructed in accordance with the invention as therein illustrated.

Figure 12:
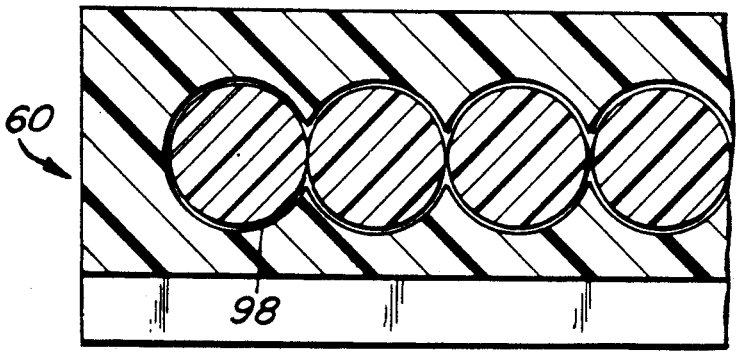
FIG. 12 is a partial front elevational view of another alternative embodiment of the pin housing structure depicted in FIG. 4 and taken along lines 11—11 as constructed in accordance with the invention.

Additionally, as further illustrated in FIG. 12, the alternative embodiment as therein illustrated evidences in place of trapezoidal opening 70 in conjunction with recess cavity 66 of pin housing structure 60 (FIG. 4) there is simply formed within the structure of pin housing structure 60 cylindrical cavities 98 that tangentially overlapping each other as therein illustrated.

Figure 13:
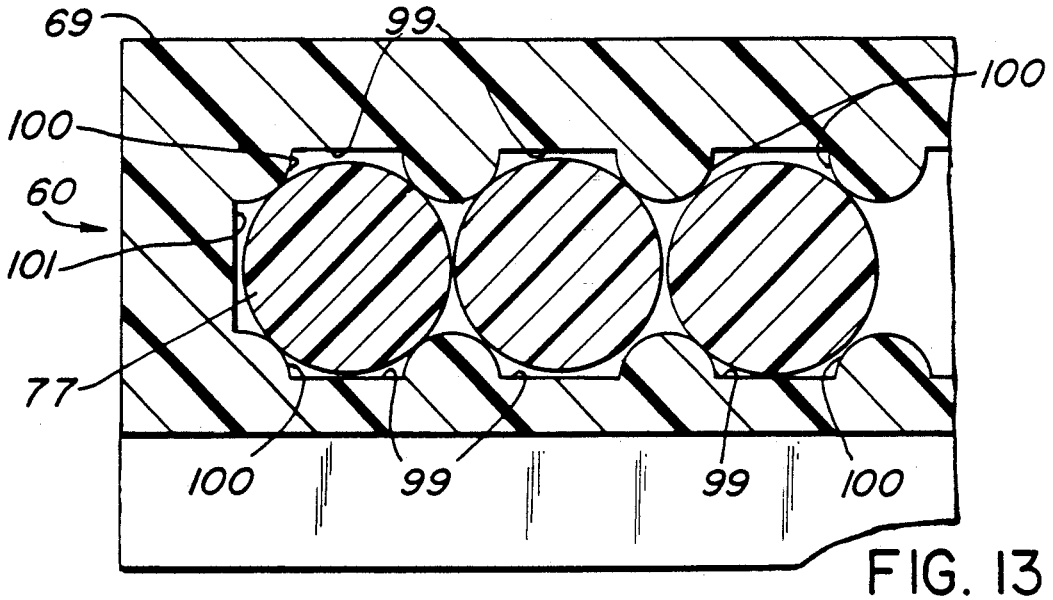
FIG. 13 is a partial front elevational view of another alternative embodiment of the pin housing structure depicted in FIG. 4 and taken along lines 11—11 as constructed in accordance with the invention.

As further illustrated in FIG. 13, the alternative embodiment as therein illustrated evidences in place of trapezoidal opening 70 in conjunction with recess cavity 66 of pin housing structure 60 (FIG. 4) there is simply formed within the structure an opening defined by a pair of parallel surfaces 99 that are spaced apart from each other a distance sufficient to allow for the insertion therebetween of pin head 77, said surfaces 99 being intersected by identical arched surfaces 100 each of said arched surfaces 100 evidencing part of a circular arch as therein illustrated, the center points for the striking of said respective arched surfaces 100 being along straight lines that pass through the center points of where a particular pin head 77 will be positioned and which radiates outward from said center points at angles of 45 degrees, 135 degrees, 225 degrees and 315 degrees, respectively and upon intersecting parallel surfaces 99, there is thus defined a center point for the drawing of an arched surface 100. As illustrated in FIG. 13, upon combining the arched surfaces 100 with parallel surfaces 99 along with end surface 101, there is defined a further alternative embodiment of the invention which defines an opening capable of receiving pin head 77 of pin member 76.

Figure 14:
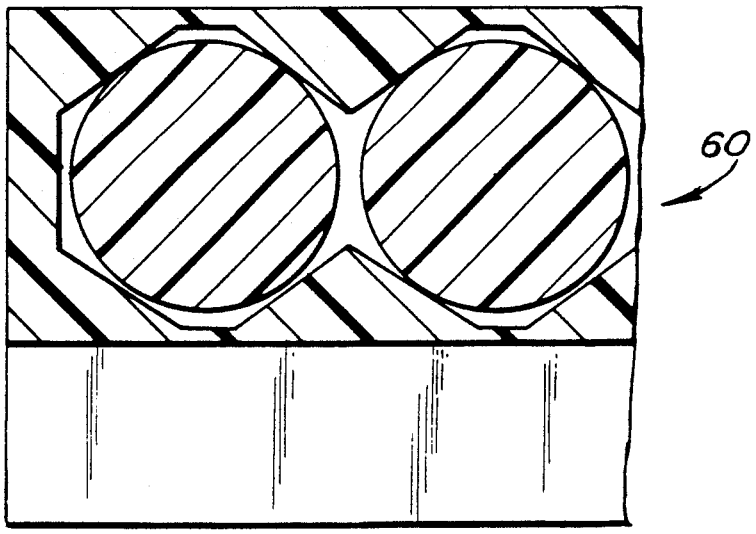
FIG. 14 is a partial front elevational view of another alternative embodiment of the pin housing structure depicted in FIG. 4 and taken along lines 11—11 as constructed in accordance with the invention.

As further illustrated in FIG. 14, the alternative embodiment as therein illustrated evidences in place of trapezoidal opening 70 in conjunction with recess cavity 66 of pin housing structure 60 (FIG. 4) there is simply formed within the structure overlapping and aligned hexagonal openings capable of receiving pin head 77 of pin member 76 as therein illustrated.

In further keeping with the invention, and as illustrated in FIG. 15, there is depicted a cross sectional view of interconnecting pin array 75 in combination with center core structure 83 and extension member 88 of page 82 or as would be the case if page 91 was being referred to therein, said structure being in accordance with the invention and as illustrative of the interconnection between the components as therein illustrated.

As therein illustrated in FIG. 15, a physical spacing exists between structural member 81 and extension member 88 of center core member 83. In accordance with the invention, upon the placement of binding strips 102 and 103 across the surface of extension member 88 and structural member 81 as illustrated in FIG. 15 and upon structurally binding same to each by use of adhesive material well known within the prior art, there is achieved between interconnecting pin array 75 and extension member 88 of center core member 83 a flexible seam running the entire length associated with the spacing existing between structural member 81 and center core member 83 as therein illustrated.

As further illustrated in FIG. 15, the thickness of structure member 81 and the thickness of extension member 88 and center core member 83 of page 82 are equal as is the case upon comparing same with extension member 93 and center core member 92 of page 91. Additionally, the thickness of binding strips 102 and 103 are equal to the thickness of bottom guide members 84 and 86 of page 82 and as to page 91, equal to the thickness of top guide member 94 and bottom guide member 95 respectively. As a result, upon assembling page 82 or page 91 in accordance with the invention and as illustrated in FIGS. 6, 9 and 15, there is achieved a singular planar surface as related to the components referred to above.

Figure 16:
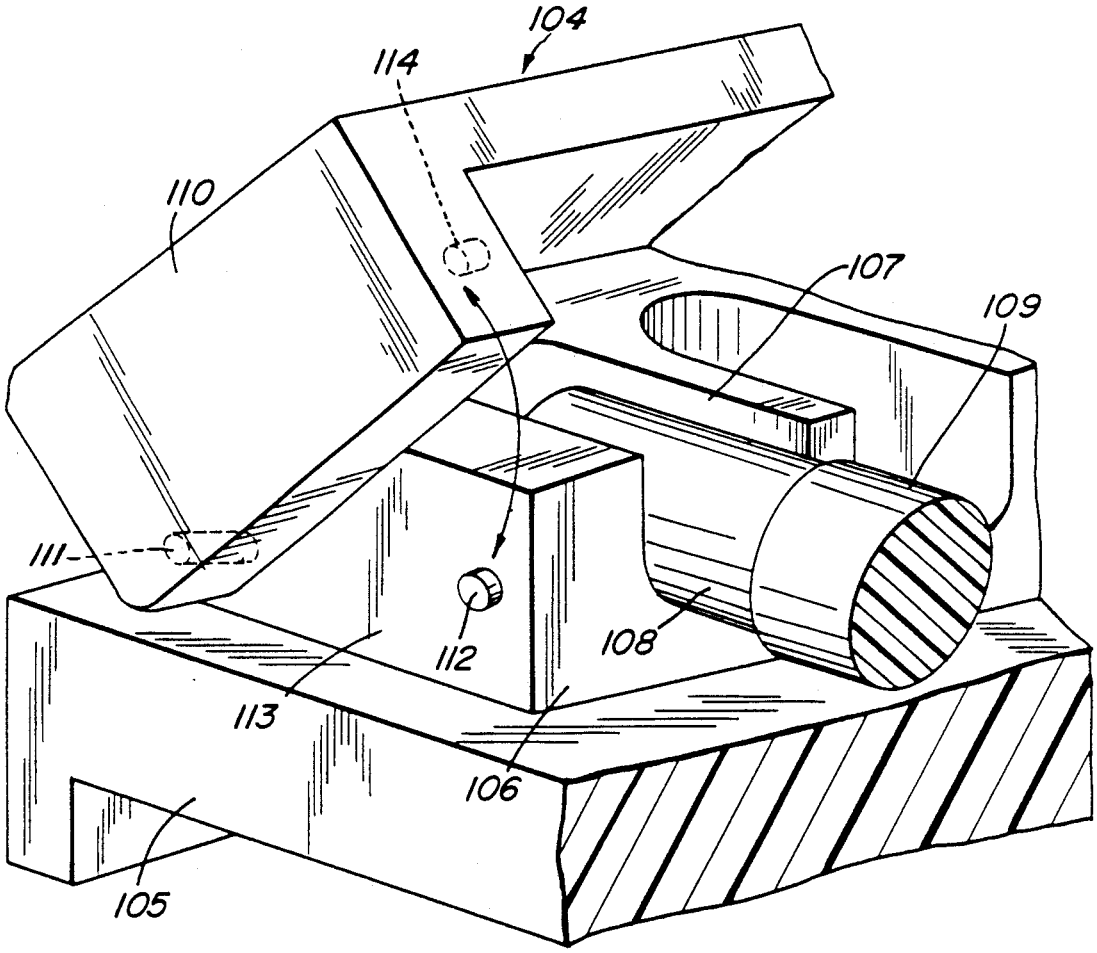
FIG. 16 is a partial three dimensional perspective view of an alternative embodiment of the pin housing structure as constructed in accordance with the invention.

In keeping with the invention, and as illustrated in FIG. 16, there is depicted an alternative embodiment of the invention utilizing an alternative pin housing structure 104 in place of pin housing structures 59 and 60.

As therein illustrated, base member 105 has positioned on its upper surface housing structure 106 which has formed therein cylindrical recess cavity 107 capable of receiving pin head 108 of pin member 109.

Additionally, locking cover 110 is rotatably hinged about pin member 111 such that locking cover 110 is capable of rotating ninety degrees about pin member 111 such that upon having locking cover 110 positioned in its vertical and, otherwise, opened position, there is the ability to mechanically placed into and/or out of recess cavity 107 pin head 108 of pin member 109.

Additionally, when locking cover 110 is rotated down into its locked position, such that locking cover 110 covers over recess cavity 107, pin head 108 of pin member 109 can no longer be vertically lifted out of recess cavity 107. Additionally, locking member 112 is formed as a cylindrical protrusion out of the exterior wall 113 of pin housing structure 104 and is capable of mechanical interfit with indent 114 formed within the interior wall of locking cover 110 immediately adjacent to locking member 112 when locking cover 110 is in its closed and otherwise locked position. In this manner, a mechanical locking feature is achieved with regard to locking cover 110. To open pin housing structure 104 locking cover 110 is lifted upward from its closed position so as to rotate about pin member 111, sufficient pressure being applied to overcome the mechanical interfit that exists between locking member 112 and indent 114. It should be noted that a comparable structure as related to pin member 111, locking member 112 and indent 114 is formed on the opposite end of locking cover 110 which is not depicted in FIG. 16.

As illustrated in FIG. 16, and in keeping with the invention, recess cavity 107 is identically repeated throughout the entire width of pin housing structure 104 and thus determines the number of pages capable of utilization within album 50.

Figure 17:
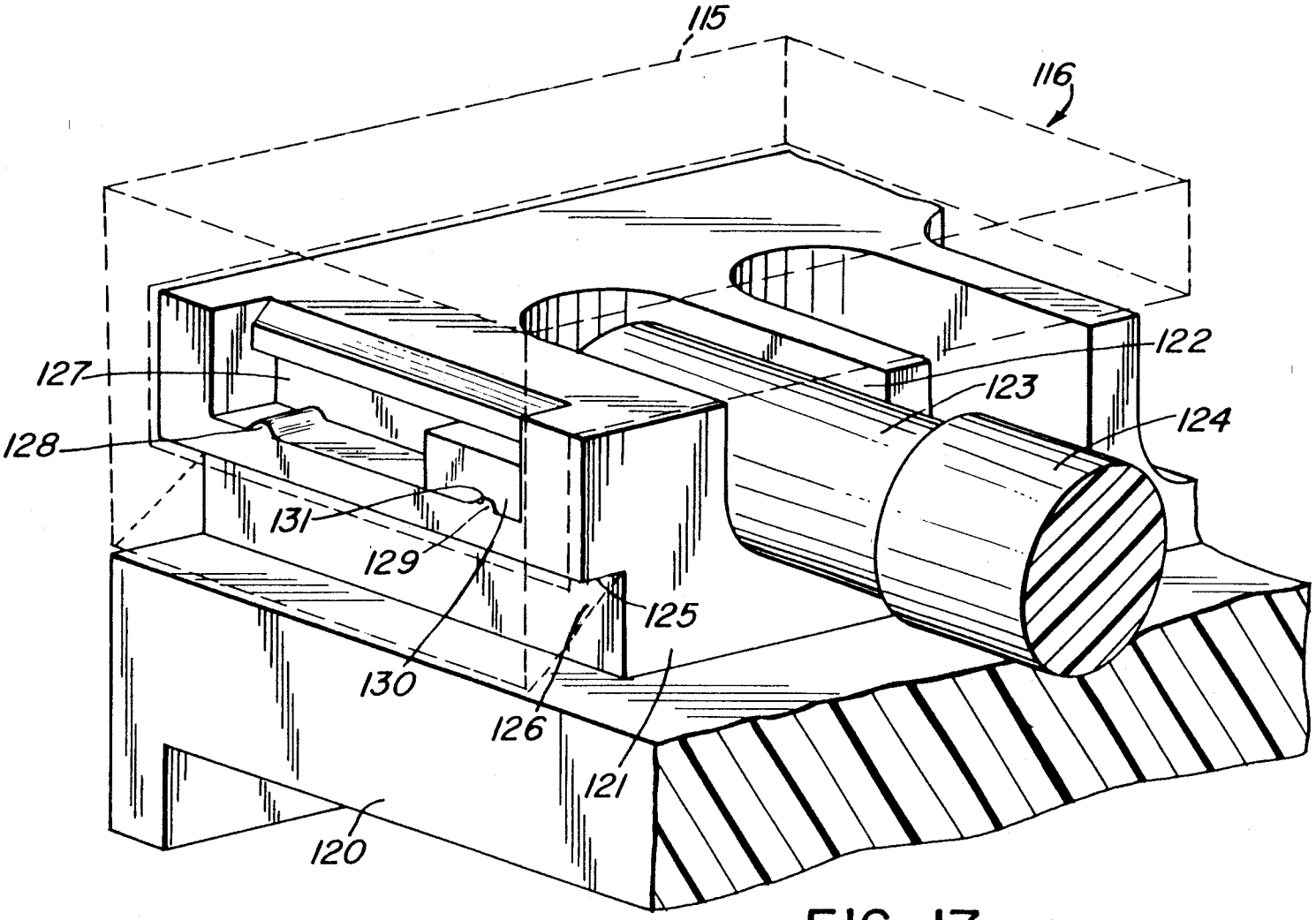
FIG. 17 is a partial three dimensional perspective view of another alternative embodiment of the pin housing structure as constructed in accordance with the invention.

Reference is now herein made to FIG. 17 wherein there is illustrated another alternative embodiment to the invention, and more particularly, a further alternative embodiment to pin housing structures 59 and 60 and a variation on the alternative embodiment depicted in FIG. 16. More particularly, upon comparing the structure of FIG. 17 with that illustrated in FIG. 16, there is evidenced the fact that whereas FIG. 16 depicts a locking cover 110 that rotates about pin member 111, FIG. 17 depicts a locking cover 115 that slides between its open and closed positions.

More particularly, there is illustrated in FIG. 17, pin housing structure 116 which is comparable to pin housing structure 104 of FIG. 16 but for the fact that locking cover 110 of pin housing structure 104 of FIG. 16 is replaced by locking cover 115 of pin housing structure 116.

As depicted in FIG. 17, base member 120 has positioned on its top surface housing structure 121 which has formed therein cylindrical recess cavity 122 capable of receiving pin head 123 of pin member 124.

Additionally, locking cover 115 is capable of sliding across the top of housing structure 121 and along an axis parallel to the axis of pin member 124 so as to prevent, in the closed position of locking cover 115 (as depicted in FIG. 17) the capability of having pin head 123 and thus pin member 124 vertically lift out from cylindrical recess cavity 122.

The means by which locking cover 115 is capable of sliding from its closed position to its open position and vice versa in relationship to housing structure 121 is along a guide surface 125 of housing structure 121, locking cover 115 having formed as depicted in FIG. 17 a tracking surface 126 which, in effect, parallels guide surface 125 of locking cover 115, thereby providing the mechanical mechanism for permitting the selected movement of locking cover 115 across the top surface of housing structure 121.

As additionally depicted in FIG. 17, and in keeping with the invention, there is further formed within indent 127 of locking cover 115 locking members 128 and 129. In conjunction therewith, there is physically affixed to the interior wall surface of locking cover 115 adjacent to indent 127 stop member 130, stop member 130 having an indent portion 131 which is structurally compatible with locking member 128 and locking member 129 such that upon indent 131 appearing in mechanical interfit with locking member 128 or locking member 129, as the case may be, there is provided a mechanical restraint upon the inadvertent sliding of locking cover 115 from either its closed position or its open position.

As illustrated in FIG. 17, locking cover 115 is in its closed position whereby indent 131 of stop member 130 is in mechanical interfit with locking member 129. Upon sliding open locking cover 115 to its open position, indent 131 of stop member 130 would then come into mechanical interfit with locking member 128. In conjunction with the above, FIG. 17 illustrates an alternative embodiment of the invention as related to a means for locking into place and/or allowing for the release of pin member 124 and thus a page of an album.

Figure 18:
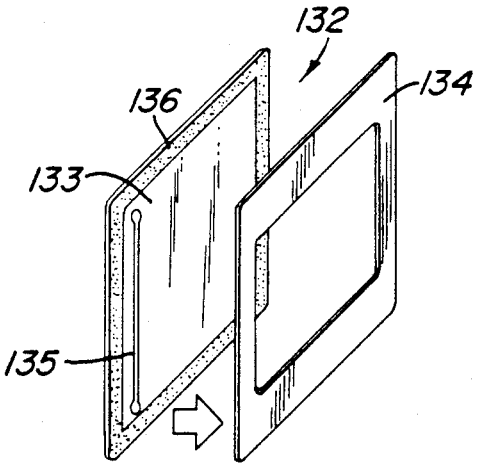
FIG. 18 is a three dimensional perspective view of an embodiment of a mat structure constructed in accordance with the invention.

Reference is now herein made to FIG. 18 wherein there is depicted in an exploded three dimensional perspective view the component parts associated with mat assembly 132 which can be utilized in combination with page 82 (FIG. 6) or page 91 (FIG. 9) in conjunction with the mounting of a picture or the like upon said pages for mounting within album 50 in accordance with the invention. More particularly, mat assembly 132 comprises a bottom mat 133 and a top mat 134. As depicted in FIG. 18, bottom mat 133 and top mat 134 are of equal outer dimensions such that, upon placing the top mat on top of said bottom mat there is achieved the mat structure of mat assembly 132 as depicted in FIG. 17.

In keeping with the invention, bottom mat 133 has formed through its structure an opening 135 as depicted in FIG. 18 as well as having formed around its perimeter an adhesive area 136. Additionally, top mat 134 has formed as depicted in FIG. 18 a rectangular opening therein and symmetrically positioned with regard thereto. In keeping with the invention, top mat 134 is adhesively affixed to bottom mat 133 along the area defined by adhesive area 136 so as to provide a unitary construction and upon so doing, there is achieved mat assembly 132 as depicted in FIG. 19.

Figure 19:
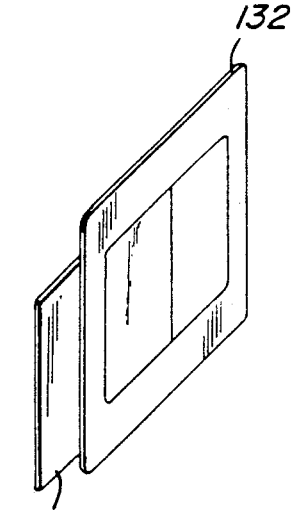
FIG. 19 is a three dimensional perspective view of the assembled mat structure as depicted in FIG. 18.

In keeping with the invention, a photo 137 is inserted through opening 135 into the envelope structure created between top mat 134 and bottom mat 133 as depicted in FIG. 19, the dimensions of photo 137 as related to the dimensions of bottom mat 133 and the location of adhesive area 136 is such that upon the complete insertion into mat assembly 132 of photo 137, the edges of photo 137 abut the interior edges of adhesive area 136. In this fashion, photo 137 effectively becomes locked into place within the envelope area defined above as related to mat assembly 132.

In keeping with the invention, and as related to the utilization of five layer page 82 (FIG. 6) and the envelope arrangement defined by album page 82 as between bottom guide member 84 and top guide member 85 as well as between bottom guide member 86 and top guide member 87 respectively, mat assembly 132 once having fully inserted therein photo 137 is then inserted through the envelope opening existing between bottom guide member 84 and top guide member 85 that exists adjacent to interconnecting pin array 75. Similarly, a comparable insertion of mat assembly 132 is applicable to the envelope opening defined between bottom guide member 86 and top guide member 87.

It should further be noted that as related to page 82 and in accordance with the invention, the outer dimensions of mat assembly 132 are compatible with insertion within the square opening formed within bottom guide member 84 such that upon insertion of mat assembly 132 into the envelope structure formed between bottom guide member 84 and top guide member 85 of page 82 (FIG. 6) there results a locking into place of mat assembly 132 due to the fact that the outer edges of mat assembly 132 come into direct contact with and otherwise abut directly against the edges of the opening formed within bottom guide member 84. Similarly, the above is also applicable to the insertion of mat assembly 132 into the reverse side of page 82 as depicted in FIG. 5.

In addition to the above, mat assembly 132 as depicted in FIGS. 18 and 19 can additionally be utilized with page 91 (FIG. 9), the actual dimensions of mat assembly 132 being compatible with the opening defined in top guide member 94 and bottom guide member 95 as depicted in FIG. 9. Upon the insertion of mat assembly 132 into the recess defined by the openings of top guide member 94 and/or bottom guide member 95 of FIG. 9, and by the utilization of any well known adhesive material such as moisturized glue, pressure sensitive adhesive, and/or the like, there is able to be achieved the placement of mat assembly 132 on to the surface of page 91 in accordance with the invention.

Figure 20:
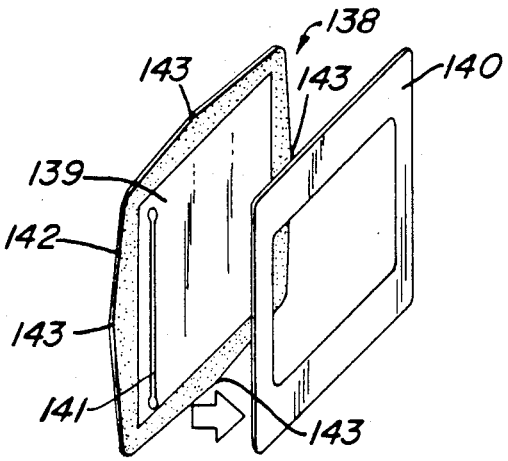
FIG. 20 is a three dimensional perspective view of another mat structure constructed in accordance with the invention.
Figure 21:
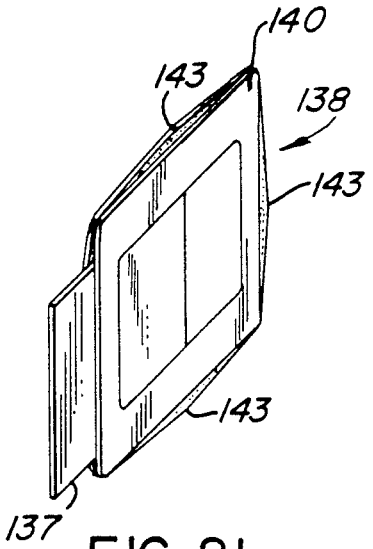
FIG. 21 is three dimensional perspective view of the assembled mat structure as depicted in FIG. 20.

In further keeping with the invention, there is further illustrated in FIG. 20 mat assembly 138 which comprises a bottom mat 139 and a top mat 140, the structure therein illustrated as to top mat 140 being identical to that of top mat 134 of FIG. 18. Additionally, bottom mat 139 is basically identical to that of bottom mat 133 of FIG. 18, bottom mat 139 having formed therein opening 141 which is identical to opening 135 (FIG. 18) and there additionally being formed around the boarder of bottom mat 139 adhesive area 142. The difference between bottom mat 139 of FIG. 20 and that of bottom mat 133 (FIG. 18) is the fact that the outer dimensions of bottom mat 139 do not define a rectangular shape, but rather, provide for protrusion points 143 such that upon the overlay of top mat 140 upon bottom mat 139 as depicted in FIG. 21 there is evidenced a triangular extension of bottom mat 139 about the perimeter of mat assembly 138 as therein depicted.

The advantage to having protrusion points 143 exist as related to mat assembly 138 is to facilitate the insertion of mat assembly 138 into the envelope openings referred to above as related to page 82 as set forth in FIG. 6. Additionally, there is further achieved an additional locking feature as related to the structure of mat assembly 138 in combination with page 82.

More particularly, upon the insertion of mat assembly 138 into the pocket defined between top guide member 85 and bottom guide member 84 of page 82 (FIG. 6) there is achieved an abutting of protrusion points 143 adjacent to the interior wall formed by the opening defined in bottom guide member 84 of page 82. Additionally, and in further keeping with the invention, the exterior dimensions of top mat 140 are compatible with and otherwise equivalent to the opening defined in top guide member 85 of page 82 such that upon insertion of mat assembly 138 into the spacing between top guide member 85 and bottom guide member 84 of page 82, there results in addition to having protrusion points 143 abut against the perimeter wall surrounding the opening formed within bottom guide member 84 and otherwise cause mat assembly 138 to be held in place as a result thereof, but additionally, the edges of top mat 140 abut against and otherwise sit within the opening defined in top guide member 85 thereby providing an additional means of locking mat assembly 138 in place.

It should additionally be noted that the above features of multiple locking only occur with regard to mat assembly 138 in conjunction with its utilization in association with page 82.

In furtherance of the invention, it should additionally be understood, that although the illustrated embodiment thereof deal with a photoalbum, nothing herein should be considered so limiting. On the contrary, the invention herein set forth is capable of being embodied in any manner comparable to a book, booklet, pamphlet, album, volume of material, or other compilation of individual page members selectively bound about a common binding, or, in the alternative, as a format for a picture frame or combination of picture frames. Furthermore, it should further be noted that nothing herein contained should be considered to limit the scope of the present invention to a particular structure associated with the interconnecting spinal component portion of a particular page, a particular page format or a particular mat design as illustrated in the drawings. More particularly, any interconnecting spinal component means, page format or mat design are within the scope of this invention as long as same are capable of utilization in the constructing of an album design consistent with the disclosure as herein set forth.

The preceding description and accompanying drawings relate primarily to a specific embodiment of the invention, and the invention in its broader aspects should not be so limited to one specific embodiment as herein shown and described, but departures may be made therefrom within the scope of the accompanying Claims without departing from the principles of the invention and without sacrificing its chief advantages.

I claim:

1. A new and improved album design in combination with an album page, said album design having a front cover member, a back cover member and a new and improved binder therebetween capable of selectively attaching and/or detaching therefrom said album page, wherein said binder comprises:

(a) a base member;

(b) a guide strip, structurally affixed to said base member;

(c) a first coupling hinge member being structurally affixed to said base member and adjacent to said guide strip and said front cover member;

(d) a second coupling hinge member being structurally affixed to said base member and adjacent to said guide strip and said back cover member but opposite to where said first coupling hinge member is adjacent to said guide strip;

(e) a first pin housing structure structurally affixed to said guide strip, said first coupling hinge member and said second coupling hinge member, and at one end of said base member wherein said first pin housing structure defines a series of laterally spaced configurations formed within the structure of said first pin housing structure wherein each such spaced configuration defines a recessed cavity formed within said first pin housing structure that overlaps with a trapezoidal opening additionally formed within said first pin housing structure directly above each said recessed cavity formed within said first pin housing structure so as to provide external access to said recessed cavity from above the top surface of said first pin housing structure via said trapezoidal opening;

(f) a second pin housing structure structurally affixed to said guide strip, said first coupling hinge member and said second coupling hinge member, and at the end of said base member opposite to where said first pin housing structure was structurally affixed, wherein said second pin housing structure additionally defines a series of laterally spaced configurations formed within the structure of said second pin housing structure identical to said laterally spaced configurations as formed within said first pin housing structure, wherein each such spaced configuration defines a recessed cavity formed within said second pin housing structure that overlaps with a trapezoidal opening additionally formed within said second pin housing structure directly above each said recessed cavity formed within said second pin housing structure so as to provide external access to said recessed cavity from above the top surface of said second pin housing structure via said trapezoidal opening, said second pin housing structure being axially aligned with said first pin housing structure so as to have the axis of the respective recessed cavities of each of said respective laterally spaced configurations aligned.

2. A new and improved album design as set forth in claim 1 wherein said laterally spaced configurations formed within said first pin housing structure and said second pin housing structure are such that said recessed cavities formed therein extend into the respective first pin housing structure and second pin housing structure beyond the point where said trapezoidal opening is therein formed.

3. A new and improved album design as set forth in claim 1 wherein said trapezoidal opening formed within said first pin housing structure and said second pin housing structure additionally defines a back wall that structurally defines an arched surface that is perpendicular to the axis of said recessed cavities formed within said first and second pin housing structures.

4. A new and improved album design as set forth in claim 1 wherein each of said laterally spaced configurations formed within said first and second pin housing structures, each said configuration further comprises a slanted guide surface intersecting a top plane surface of said first and second pin housing structures and said respective recessed cavity.

5. A new and improved album design in combination with an album page, said album design having a front cover member, a back cover member and a new and improved binder therebetween said of selectively attaching and/or detaching therefrom said album page, said album comprising:

(a) a base member;

(b) a guide strip, structurally affixed to said base member;

(c) a first coupling hinge member being structurally affixed to said base member and adjacent to said guide strip and said front cover member;

(d) a second coupling hinge member being structurally affixed to said base member and adjacent to said guide strip and said back cover member but opposite to where said first coupling hinge member is adjacent to said guide strip;

(e) a first pin housing structure structurally affixed to said guide strip, said first coupling hinge member and said second coupling hinge member, and at one end of said base member wherein said first pin housing structure defines a series of laterally spaced configurations formed within the structure of said first pin housing structure wherein each such spaced configuration defines a recessed cavity formed within said first pin housing structure that overlaps with a trapezoidal opening additionally formed within said first pin housing structure directly above each said recessed cavity formed within said first pin housing structure so as to provide external access to said recessed cavity from above the top surface of said first pin housing structure via said trapezoidal opening;

(f) a second pin housing structure structurally affixed to said guide strip, said first coupling hinge member and said second coupling hinge member, and at the end of said base member opposite to where said first pin housing structure was structurally affixed, wherein said second pin housing structure additionally defines a series of laterally spaced configurations formed within the structure of said second pin housing structure identical to said laterally spaced configurations as formed within said first pin housing structure, wherein each such spaced configuration defines a recessed cavity formed within said second pin housing structure that overlaps with a trapezoidal opening additionally formed with said second pin housing structure directly above each said recessed cavity formed within said second pin housing structure so as to provide external access to said recessed cavity from above the top surface of said second pin housing structure via said trapezoidal opening, said second pin housing structure being axially aligned with said first pin housing structure so as to have the axis of the respective recessed cavities of each of said respective laterally spaced configurations aligned;

(g) an album page comprising:

(i) a center core member additionally defining an extension member;

(ii) a top guide member defining an opening, said top guide member being structurally affixed to the front surface of said center core member;

(iii) a bottom guide member defining an opening, said bottom guide member being structurally affixed to the back surface of said center core member;

(iv) an interconnecting pin array structurally affixed to said extension member of said center core member so as to allow for flexible movement therebetween, said pin array comprising a pin member having a pin head on each of its respective ends, each said pin head being cylindrical in shape, said pin head additionally being capable of insertion into said recessed cavity defined in said first pin housing structure and said second pin housing structure so as to selectively and rotatably affix thereto said album page.

6. A new and improved album design having a new and improved binder capable of having selectively attached and/or detached therefrom an album page, as defined in claim 5, and further comprising a mat assembly consisting of a bottom mat having defined about its boarder an adhesive area wherein there is further defined by said bottom mat an opening formed therethrough within the area surrounded by said adhesive area, and a top mat, defining a central opening, said top mat being structurally affixed to said bottom mat by said adhesive area, said mat assembly capable of receiving a pictorial display between said top mat and said bottom mat by insertion through said opening formed within said bottom mat whereby said pictorial display is then mounted within said mat assembly for placement of said mat assembly within the opening defined by either said top guide member or said bottom guide member of said album page.

7. A new and improved album design in combination with an album page, said album design having a front cover member, a back cover member and a new and improved binder therebetween capable of selectively attaching and/or detaching therefrom said album page, said album comprising:

(a) a base member;

(b) a guide strip, structurally affixed to said base member;

(c) a first coupling hinge member being structurally affixed to said base member and adjacent to said guide strip and said front cover member.

(d) a second coupling hinge member being structurally affixed to said base member and adjacent to said guide strip and said back cover member but opposite to where said first coupling hinge member is adjacent to said guide strip;

(e) a first pin housing structure structurally affixed to said guide strip, said first coupling hinge member and said second coupling hinge member, and at one end of said base member wherein said first pin housing structure defines a series of laterally spaced configurations formed within the structure of said first pin housing structure wherein each such spaced configuration defines a recessed cavity formed within said first pin housing structure that overlaps with a trapezoidal opening additionally formed with said first pin housing structure directly above each said recessed cavity formed within said first pin housing structure so as to provide external access to said recessed cavity from above the top surface of said first pin housing structure via said trapezoidal opening;

(f) a second pin housing structure structurally affixed to said guide strip, said first coupling hinge member and said second coupling hinge member, and at the end of said base member opposite to where said first pin housing structure was structurally affixed, wherein said second pin housing structure additionally defines a series of laterally spaced configurations formed within the structure of said second pin housing structure identical to said laterally spaced configurations as formed within said first pin housing structure, wherein each such spaced configuration defines a recessed cavity formed within said second pin housing structure that overlaps with a trapezoidal opening additionally formed within said second pin housing structure directly above each of said recessed cavities formed within said second pin housing structure so as to provide external access to said recessed cavity from above the top surface of said second pin housing structure via said trapezoidal opening, said second pin housing structure being axially aligned with said first pin housing structure so as to have the axis of the respective recessed cavities of each of said respective laterally spaced configurations aligned;

(g) an album page comprising:

(i) a center core member additionally defining an extension member;

(ii) a first top guide member defining an opening, said top guide member being structurally affixed to the front structure of said center core member;

(iii) a first bottom guide member defining an opening, said bottom guide member being structurally affixed to the back surface of said center core member;

(iv) a second top guide member defining an opening symmetrical to the opening defined in said first top guide member but of lesser dimensions, said second top guide member being structurally affixed to said first top guide member except along the common surface adjacent to said extension member of said center core member;

(v) a second bottom guide member defining an opening symmetrical to the opening defined in said first bottom guide member but of lesser dimensions, said second bottom guide member being structurally affixed to said first bottom guide member except along the common surface adjacent to said extension member of said center core member;

(vi) an interconnecting pin array structurally affixed to said extension member of said center core member so as to allow for flexible movement therebetween, said pin array comprising a pin member having a pin head on each of its respective ends, each pin head being cylindrical in shape, said pin head additionally being capable of insertion into said recessed cavity defined in said first pin housing structure and said second pin housing structure so as to selectively and rotatably affix thereto said album page.

8. A new and improved album design in combination with an album page, said album design having a new and improved binder capable of selectively attaching and/or detaching therefrom said album page, as defined in claim 7, and further comprising a mat assembly consisting of a bottom mat having defined about its boarder an adhesive area wherein there is further defined by said bottom mat an opening formed therethrough within the area surrounded by said adhesive area, and a top mat, defining a central opening, said top mat being structurally affixed to said bottom mat by said adhesive area, said mat assembly capable of receiving a pictorial display between said top mat and said bottom mat by insertion through said opening formed within said bottom mat whereby said pictorial display is then mounted within said mat assembly for placement of said mat assembly within the opening defined by said first bottom guide member with said first top guide member or by said second bottom guide member with said second top guide member of said album page.

9. A new and improved album design in combination with an album page, said album design having a new and improved binder capable of selectively attaching and/or detaching therefrom said album page, as defined in claim 7, and further comprising a mat assembly consisting of a bottom mat having defined about its boarder an adhesive area wherein there is further defined by said bottom mat an opening formed therethrough within the area surrounded by said adhesive area, and a top mat, defining a central opening, said top mat being structurally affixed to said bottom mat by said adhesive area, said mat assembly capable of receiving a pictorial display between said top mat and said bottom mat by insertion through said opening formed within said bottom mat whereby said pictorial display is then mounted within said mat assembly for placement of said mat assembly within the opening defined by said first bottom guide member with said first top guide member or by said second bottom guide member with said second top guide member of said album page, said bottom mat defining exterior dimensions greater than said top mat.

10. A new and improved album design having a new and improved binder capable of having selectively attached and/or detached therefrom an album page, as defined in claim 9, whereby the exterior dimensions of said bottom mat triangular configurations that extend beyond the dimensions of said top mat.

11. A new and improved album design in combination with an album page, said album design having a front cover member, a back cover member and a new and improved binder therebetween capable of selectively attaching and/or detaching therefrom said album page, wherein said binder comprises:

(a) a base member;

(b) a guide strip, structurally affixed to said base member;

(c) a first coupling hinge member being structurally affixed to said base member and adjacent to said guide strip and said from cover member;

(d) a second coupling hinge member being structurally affixed to said base member and adjacent to said guide strip and said back cover member but opposite to where said first coupling hinge member is adjacent to said guide strip;

(e) a first pin housing structure structurally affixed to said guide strip, said first coupling hinge member and said second coupling hinge member, and at one end of said base member wherein said first pin housing structure defines a series of laterally spaced configurations formed within the structure of said first pin housing structure wherein each such spaced configuration defines a recessed cavity formed within said first pin housing structure, each recessed cavity allowing for the external access to said recessed cavity from above the top surface of said first pin housing structure;

(f) a second pin housing structure structurally affixed to said guide strip, said first coupling hinge member and said second coupling hinge member, and at the end of said base member opposite to where said first pin housing structure was structurally affixed, wherein said second pin housing structure additionally defines a series of laterally spaced configurations formed within the structure of said second pin housing structure identical to said laterally spaced configurations as formed within said first pin housing structure, wherein each such spaced configuration defines a recessed cavity formed within said second pin housing structure, said recessed cavity allowing for the external access to said recessed cavity from above the top surface of said second pin housing structure, said second pin housing structure being axially aligned with said first pin housing structure so as to have the axis of the respective recessed cavities of each of said respective laterally spaced configurations aligned.

12. A new and improved album design in combination with an album page, said album design having a new and improved binder capable of selectively attaching and/or detaching therefrom said album page, as defined in claim 11, additionally comprising:

(a) a first locking cover member capable of being rotatably affixed about a first singular axis point affixed to said first pin housing structure, said first locking cover being structurally positioned across said recessed cavities of said first pin housing structure when in its closed position, and when said first locking cover member is rotated about said first singular axis point away from said recessed cavities, said first locking cover exposes said recessed cavities formed within said first pin housing structure; and (b) a second locking cover member capable of being rotatably affixed about a second singular axis point affixed to said second pin housing structure, said second locking cover being structurally positioned across said recessed cavities of said second pin housing structure when in its closed position, and when said second locking cover member is rotated about said second singular axis point away from said recessed cavities, said second locking cover exposes said recessed cavities formed within said second pin housing structure.

13. A new and improved album design in combination with an album page, said album design having a new and improved binder capable of selectively attaching and/or detaching therefrom said album page, as defined in claim 11, additionally comprising:

(a) a first locking cover member capable of sliding along guide surfaces formed along opposite external faces of said first pin housing structure so as to allow for lateral movement of said first locking cover member as related to the top surface of said first pin housing structure, said first locking cover being structurally positioned across said recessed cavities of said first pin housing structure when in its closed position; and (b) a second locking cover member capable of sliding along opposite external faces of said second pin housing structure so as to allow for lateral movement of said second locking cover member as related to the top surface of said second pin housing structure, said second locking cover being structurally positioned across said recessed cavities of said second pin housing structure when in its closed position.

* * * * *